United States Patent [19]

Ganz

[11] Patent Number: 4,844,640

[45] Date of Patent: Jul. 4, 1989

[54] SIMPLIFIED RETRACTABLE TIP WRITING INSTRUMENT

[75] Inventor: Walter C. Ganz, New York, N.Y.

[73] Assignee: Walgan Corporation, New York, N.Y.

[21] Appl. No.: 236,302

[22] Filed: Aug. 23, 1988

Related U.S. Application Data

[63] Continuation of Ser. No. 905,792, Sep. 10, 1986, abandoned.

[51] Int. Cl.[4] ..... B43K 7/12; B43K 24/14

[52] U.S. Cl. ..... 401/116; 401/109

[58] Field of Search ..... 401/109, 110, 112, 116

[56] References Cited

U.S. PATENT DOCUMENTS

| | | | |
|---|---|---|---|
| 750,583 | 1/1904 | Brown | 401/116 |
| 2,690,163 | 9/1954 | Randolph | 401/116 |
| 2,837,057 | 6/1958 | Morlock et al. . | |
| 3,153,479 | 10/1964 | Hultgren . | |
| 3,266,465 | 8/1966 | Ganz . | |
| 3,597,100 | 8/1971 | Ganz . | |
| 3,679,318 | 7/1972 | Liguori . | |
| 3,792,931 | 2/1974 | Ganz . | |
| 3,898,008 | 8/1975 | Ganz . | |
| 4,221,490 | 9/1980 | Malm . | |
| 4,272,206 | 6/1981 | Treen | 401/116 X |
| 4,283,151 | 8/1981 | Sekiguchi . | |

FOREIGN PATENT DOCUMENTS

| | | | |
|---|---|---|---|
| 477244 | 9/1951 | Canada | 401/116 |
| 1272172 | 7/1968 | Fed. Rep. of Germany | 401/112 |
| 2308299 | 9/1973 | Fed. Rep. of Germany | 401/116 |
| 967992 | 11/1950 | France . | |
| 1004813 | 4/1952 | France . | |
| 1270645 | 7/1961 | France . | |
| 444447 | 1/1949 | Italy . | |
| 446650 | 3/1949 | Italy . | |
| 518042 | 3/1955 | Italy . | |
| 788257 | 12/1957 | United Kingdom | 401/116 |
| 806296 | 12/1958 | United Kingdom | 401/116 |
| 1091826 | 11/1967 | United Kingdom | 401/110 |

*Primary Examiner*—Steven A. Bratlie

*Attorney, Agent, or Firm*—Brumbaugh, Graves, Donohue & Raymond

[57] ABSTRACT

A simplified retractable writing instrument includes a barrel and a cap with end portions telescopically joined near the mid portion of the instrument. Internally a cartridge is spring biased towards a retracted position with an end remote from its writing tip engaged by a closure plug secured to the cap. The end portion of the barrel received telescopically in the cap includes a slanted slot. The slot's edges engage a rivet that projects inwardly from the cap. Rotation of the barrel relative to the cap causes axial movement of the one with respect to the other. This axial movement forces the writing cartridge to project its tip from the barrel by virtue of the abutment by the plug. Return axial movement permits retraction by the biasing spring.

1 Claim, 1 Drawing Sheet

SIMPLIFIED RETRACTABLE TIP WRITING INSTRUMENT

This application is a continuation of application Ser. No. 905,792, filed on 9/10/86, now abandoned.

BACKGROUND OF THE INVENTION

This invention relates to writing instruments with retractable tips and more particularly to such instruments in which relative rotation of portions of the body of the instrument effects retraction and projection of the writing tip.

Numerous writing instruments with retractable tips have been known. These have often employed complex internal mechanisms to effect projection and retraction of the tip of, for example, a ball-point cartridge, spring biased towards the retracted position. Internal cams have been employed to this end, and these have been activated and released by push buttons, located at the end of such instruments or beneath the pocket clip, or by rotation of a part of the body of the instrument.

In twist-activated instruments, relative rotation between halves of the instrument body causes projection and retraction of the writing tip. Internally housed cam members, turned by the relative rotation of the housing parts, have forced projection of the writing tip against the bias of the spring when the two body portions are rotated with respect to one another. In these instruments, the two body portions, ordinarily a barrel and a cap, do not move axially with respect to each other, but cause the relative rotation of the internal cam parts that effects axial movement of a cartridge by cam operation. These instruments have been unduly complex by virtue of their internal construction. In some of these, separate provision had to be made to prevent separation of the relatively rotatable body portions of the instrument.

Simplification of the actuating provisions of writing instruments with retractable points reduces costs significantly, not just by reducing the number of working parts and hence the cost of manufacture, but by simplifying assembly and in that way reducing manufacturing cost. Likewise, elimination of the need for separate provisions preventing disassembly of the instrument could further simplify production and assembly and lead to cost reduction.

BRIEF SUMMARY OF THE INVENTION

This invention relates to a simplified writing instrument with a retractable writing tip and having two housing parts, the barrel and the cap, that are relatively rotatable to effect projection and retraction of the writing tip via cam provisions cooperating between the two rotatable housing parts, and more particularly to such an instrument wherein the two housing parts are connected in telescoping relation with the interior telescoped part slotted to form cam surfaces and an inward projection from the exterior part cooperating with the slot to cause axial movement between the parts effecting extension and retraction of the writing tip.

By utilizing the barrel and cap of the writing instrument as the actuating provisions, multiple internal actuating parts are eliminated. Assembly is greatly simplified. The cap of the instrument, in a preferred form, carries a fixed member that engages the end of an internal ink cartridge terminating at its further end in the writing tip. Partial rotation of the cap with respect to the barrel cams the cap towards the writing end of the instrument by virtue of a slanted slot receiving the inward projection from the cap where the barrel and cap are telescoped. The fixed member carried by the cap and engaging the cartridge forces the cartridge to move against the bias of a spring urging retraction. The slot terminates at one end in a generally circumferential portion that allows the inward projection, which is preferably a force fit rivet, to seat at that end of the slot and resist retraction along the slotted cam surface of the slot when the instrument is used. Attention to the length of the barrel and to the placement of the slot can locate the rivet in a concealed location beneath the instrument's pocket clip.

the inward projection or rivet and its cooperation with the slot prevent disassociation of the telescopically joined barrel and cap so that no further provisions need retain these two parts together. The fixed member carried by the cap may be a plug closing the cap end. Internally the only parts to be found that are not portions of the body of the instrument are the cartridge and its retraction-urging spring. It will be appreciated that a very simple yet quite reliable instrument results. Only a partial rotation of the cap is required to project or retract the writing tip. Cost of production and assembly is significantly reduced over those prior instruments that utilize complex interior mechanisms.

The foregoing and further objects and advantages of the invention will be better understood with reference to the following detailed description of a preferred embodiment taken together with the accompanying drawings.

DETAILED DESCRIPTION OF PREFERRED EMBODIMENT

Figure 1:
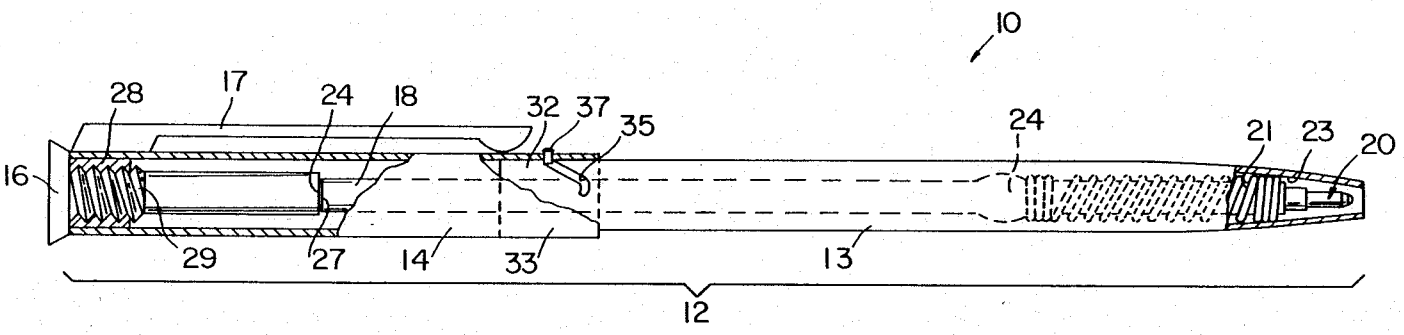
FIG. 1 is a plan view of a writing instrument in accordance with the invention with parts broken away for clarity and shows the retractable writing tip, and the camming provisions that effect projection and retraction of the writing tip.

Turning now to the drawings in detail, in FIG. 1 a writing instrument 10 has a body portion 12 comprising a barrel 13 and a cap 14. At its end remote from the writing end of the instrument, a plug 16 closes the cap 14. A typical clip 17 is provided. Within the body portion 12, an ink cartridge 18 has a writing tip 20 biased towards retraction by a spring 21. The spring 21 acts between a narrowing portion of the barrel at location 23 and a widened pinch 24 in the cartridge. The spring 21 biases the remote end 24 of the cartridge against an abutting end 27 of the plug 16. An internal threaded female sleeve or connector 28 is force fit or otherwise secured in the inside diameter of the cap 14 and mates with a threaded portion 29 of the plug 16.

Figure 2:
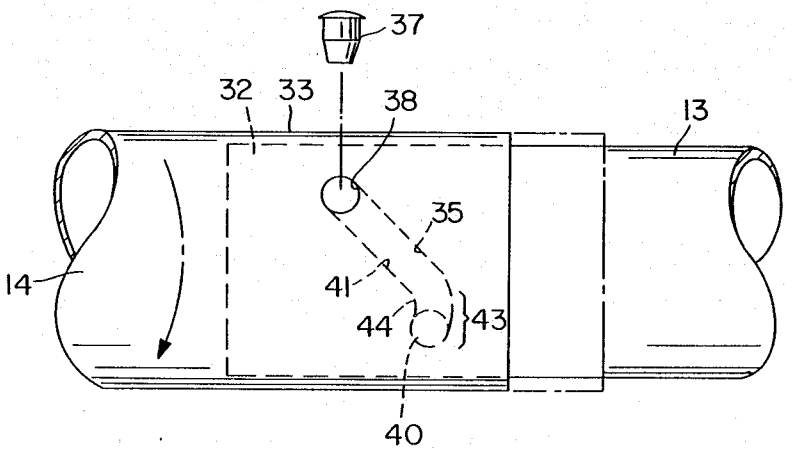
FIG. 2 is an enlarged fragmentary plan view of the camming provisions of FIG. 1 and shows the configuration of a camming slot and rivet.

The barrel 13 and the cap 14 connect in telescoping relation at telescoped end portions 32 and 33. A slot 35 in the end portion 32 of the barrel coacts with a rivet 37 that is press fit or otherwise secured in a hole 38 (better seen in FIG. 2) in the telescoping end portion 33 of the cap 14. The slot 35 is slanted, which is to say it extends both circumferentially and axially of the barrel 13 into which it is formed. The slot is closed at its ends. That is, it terminates at end edges rather than continuing to the end of the barrel. The barrel and cap are rotatable relative on another to the extent permitted by the location of the rivet 37 in the slot 35. Relative rotation of the two parts causes axial movement therebetween. For example, in FIG. 2, the two parts are shown in their writing tip retracted position with the cap 14 drawn back away from the writing tip end of the instrument. In this position, as can be seen also in FIG. 1, the abutting end 27 of the plug permits the cartridge 18 to be moved back into its retracted position with the writing tip 20 inside the pen body under the influence of the spring 21. Rotation of the cap 14 in the direction of the unnumbered arrow of FIG. 2 relative to the barrel 13 moves the rivet 37 to its second position shown in phantom outline at location 40 in FIG. 2. Cam engagement of the rivet 37 along the slanted surface 41 of the slot 35 forces the cap to its phantom outlined position in FIG. 2. Likewise, the plug 16 secured in the cap 14 engages the end 24 of the cartridge at its end 27 to extend the writing tip 20 from the writing end of the body 12 of the instrument against the bias of the spring 21. At the position 40, the slot 35 has a circumferentially extending portion 43 and a slight projection 44 that resist return movement of the rivet along the slot 35 to the writing tip-retracted position when the writer bears down on the tip to write.

It will be seen that a greatly simplified instrument ahs been provided that is perfectly reliable, has a reduced number of moving parts, has its retraction and projection mechanism well hidden, and is easy to assemble. The rivet and slot 37 and 35 serve not just as-the camming provisions, but to secure together the body 12 of the writing instrument 10 preventing separation of the barrel and cap.

Whereas a single preferred embodiment of the invention has been described in detail, it will be readily apparent to those skilled in the art that modifications may be made without departure from the spirit and scope of the invention as set out in the appended claims.

I claim:

1. The A writing instrument comprising a tubular barrel, a tubular cap having an end portion received telescopically over an end portion of the barrel in overlapping relation for movement of the cap relative to the barrel both rotationally and axially, a writing cartridge received in the barrel for axial movement therein between a retracted position in which its writing tip is located within the barrel and an extended position in which the writing tip projects from the end of the barrelr emote from the cap, a spring engaged between the barrel and cartridge and biasing the cartridge toward the retracted position, a plug removably joined to and closing the cap and having an end abutting the end of the cartridge remote from the writing tip, a cam slot formed in the end portion of the barrel where it is overlapped by the cap, the cam slot extending circumferentially and axially of the barrel and being closed at its ends by end edges and having a circumferentially extending end portion adjacent the end thereof nearer to the writing tip of the cartridge, a hole in the end portion of the cap where it overlaps the barrel, and a rivet press fit in the hole in the cap and projecting radially inwardly into the slot and engageable with a side edge of the slot to cause axial movement of the cap and thereby axial movement of the cartridge along the barrelwhen the cap is rotated relative to the barrel and also engageable with the respective end edges of the slot to define the respective extended and retracted positions of the cartridge and to prevent disassociation of the barrel and cap and retain them permanently in telescopically joined relation for relative movement only to an extent establishing the extended and retracted positions of the cartridge.

* * * * *